United States Patent [19]

Bird et al.

[11] Patent Number: 4,984,374

[45] Date of Patent: Jan. 15, 1991

[54] ROTARY DRIER CONTROL BY ADJUSTMENT OF AIR FLOW OR AIR HUMIDITY

[75] Inventors: Derek G. Bird, Stockbridge; Anthony S. Westlake, Winchester, both of England

[73] Assignee: GBE International plc, Andover, England

[21] Appl. No.: 411,492

[22] PCT Filed: Feb. 13, 1989

[86] PCT No.: PCT/GB89/00145

§ 371 Date: Oct. 10, 1989

§ 102(e) Date: Oct. 10, 1989

[87] PCT Pub. No.: WO89/07401

PCT Pub. Date: Aug. 24, 1989

[30] Foreign Application Priority Data

Feb. 13, 1988 [GB] United Kingdom ..... 8803380

[51] Int. Cl.[5] ..... F26B 21/08

[52] U.S. Cl. ..... 34/50; 34/46; 34/133

[58] Field of Search ..... 34/50, 54, 133, 135, 34/136, 137, 141, 46; 131/133, 134, 135, 136, 137, 140 R, 140 A

[56] References Cited

U.S. PATENT DOCUMENTS

| | | | |
|---|---|---|---|
| 2,877,562 | 3/1959 | Krantz | 34/29 |
| 3,372,488 | 3/1968 | Koch et al. | 34/136 |
| 3,389,707 | 6/1968 | Wochnowski | 131/135 |
| 3,409,025 | 11/1968 | Wochnowski | 34/46 |
| 3,905,123 | 9/1975 | Fowler et al. | 34/46 |
| 3,906,961 | 9/1975 | Rowell et al. | 34/46 |
| 3,948,277 | 4/1976 | Wochnowski et al. | 34/46 |
| 4,143,471 | 3/1979 | Wochnowski et al. | 34/50 |
| 4,186,755 | 2/1980 | Schmidt | 34/91 |
| 4,346,524 | 8/1982 | Wochnowski et al. | 34/46 |
| 4,434,563 | 3/1984 | Graalmann et al. | 34/46 |
| 4,513,759 | 4/1985 | Wochnowski et al. | 34/46 |

FOREIGN PATENT DOCUMENTS

| | | |
|---|---|---|
| 2638446 | 3/1978 | Fed. Rep. of Germany . |
| 2447685 | 8/1980 | France . |
| 1209929 | 10/1970 | United Kingdom . |

*Primary Examiner*—Henry A. Bennet
*Assistant Examiner*—Denise L. Gromada
*Attorney, Agent, or Firm*—James Creighton Wray

[57] ABSTRACT

A rotary cut tobacco drier, comprising a heated rotary drier chamber having one or more inclined paddles arranged to lift and then drop material therein to be dried as the chamber rotates. The chamber is provided with an air inlet to which air is supplied by a blower through a heater and a duct. The chamber is also provided with an air outlet through which air is extracted from the chamber by means of an exhaust fan to pass to a cyclone duct separator. The air inlet and the air outlet are arranged so that there is a substantially constant flow of air between them. A pivoted damper flap is provided to control the humidity of the air entering or in the chamber, an increase in humidity decreasing the rate of drying in the chamber.

7 Claims, 2 Drawing Sheets

ROTARY DRIER CONTROL BY ADJUSTMENT OF AIR FLOW OR AIR HUMIDITY

BACKGROUND OF THE INVENTION

This invention concerns the control of a rotary cut tobacco drier, of the single cylinder type described in our

STATEMENT OF PRIOR ART

UK Patent No. 1,209,929 or the double cylinder type described in our UK Patent No. 1,345,373. In particular the invention is concerned with the short term or fast response control of such driers, in which it is necessary to achieve a constant moisture content in tobacco leaving the outlet from the drier, while compensating for variation in the moisture content in tobacco fed to the drier.

Rotary cylindrical driers have on their inside a number of longitudinal paddles which first lift and then drop the material being dried. The axis of the cylinder is slightly inclined to the horizontal so that the material progresses down the cylinder each time it is dropped and will typically take 3 to 6 minutes to progress through the cylinder.

Both the cylinder and paddles are of tubular construction and heated by steam or high pressure hot water to provide the heat for drying. Alternatively in another form of single cylinder construction the cylinder is heated on the outside by flue gases from a gas or oil flame.

In either case the rate of response of the cylinder and paddles to changes in temperature is relatively slow due to the thermal capacity of the cylinder and paddles.

Air is also passed through the cylinder either in the same direction as the tobacco flow or in the opposite direction. The prime purpose of such air flow is to carry away the evaporated moisture, but in addition, if the air is heated, some small additional drying action may be achieved.

It is normal to measure the flow rate of the tobacco entering the drier by a weighing conveyor and its moisture content by means of a continuous moisture meter, and from these measurements to make a prediction of the cylinder temperature required to achieve desired output moisture content in the tobacco i.e. a feed forward control.

Further because the dwell time within the cylinder can be 3 to 6 minutes and because of the thermal capacity of the cylinder, it cannot respond readily to varying flow rate or moisture content. So input variations or inaccurate predictions can result in output errors sensed by an output moisture meter, which take 5 minutes or more to correct by alteration of cylinder temperature i.e. a feed back control.

To reduce this delay the air temperature can be raised to provide some quicker acting feed back control, particularly if the air flow is contra flow. However to be effective the air has to be at least as hot as the cylinder, and because the thermal capacity of the air is small the amount of adjustment is small. The effect is confined to the tobacco about to be discharged, so that the standard deviation of the moisture content can be doubled.

Alternatively the air flow rate can be varied to provide some quick-acting feed back control.

The main driving force for drying is the heat transfer from cylinder and paddles to the tobacco, which is dependent on the temperature difference between cylinder and tobacco. The cylinder temperature is determined by the heat supply and can be controlled to a fixed level. The tobacco temperature is comparable with a wet bulb temperature determined by the humidity of the air in the drier, in which the vapor pressure of the moisture at the surface of the tobacco exceeds the vapor pressure of the air.

A reduction in air flow through the drier results in an increase in air humidity, so the tobacco increases in temperature to increase its vapor pressure and to maintain the evaporation. The rise in tobacco temperature is a reduction in temperature difference from the cylinder and a reduction in moisture removal. It is preferable if the air flow is in-line with and in the same direction as the tobacco flow so that the highest humidity is at the delivery end, but a contra-flow arrangement may be used in some circumtances.

The air flow through a drier is normally arranged on a push pull system; that is a fan is used to blow air into the drier, via an air heater if required, and a further fan is used to extract the air and pass it to a cyclone or filter dust separator. In this way the drier can be arranged to be substantially at atmospheric pressure, so that the inlet and outlet do not need to be fully sealed.

The tobacco inlet to the drier is usually better sealed than the tobacco outlet, so the two air flows are balanced by adjusting the exhaust until there is no escape of air and dust at the tobacco outlet but only a very slight suction.

If the inlet air flow rate is being automatically adjusted by a damper to control the drier then the balance must be made automatically. This necessitates a very sensitive and difficult measurement of suction pressure in the delivery hood of less than 0.01" WG (0.25 mm). It also means that the exhaust air is being adjusted away from the optimum for conveying the dust and the optimum for efficient operation of a cyclone dust separator.

Our Pat. No. 1,209,929 describes how a fixed amount of air from the inlet fan is passed through one section of an air heater and then by means of bypass ducts is blown direct into the discharge hood where it mixes with air which has passed through the drier to prevent condensation of moisture from the latter. This is known as booster air.

The main amount of air from the inlet fan is adjustably divided into two parts, one passing through the heater and the other part by passing the heater. The two parts are then combined to pass through the drier.

By adjusting the division the temperature of the combined air can be altered.

OBJECT OF THE INVENTION

It is an object of the present invention to provide an improved arrangement for the control of the drying operation in such driers.

SUMMARY OF THE INVENTION

Accordingly the present invention provides a rotary cut tobacco drier, comprising a heated rotary drier chamber having one or more inclined paddles arranged to lift and then drop material therein to be dried as the chamber rotates, means for supplying heated air from a heater to one end of the chamber, and means for extracting it from an opposite end of the chamber, said supply and extraction means being arranged so that there is a substantially constant flow of air between them; in which means is provided to control the humidity of the air entering or in the chamber, an increase in humidity decreasing the rate of drying in the chamber.

Other advantages and features of the invention will be apparent from the disclosure, which includes the above and ongoing specification with the claims and the drawings.

BRIEF DESCRIPTION OF THE INVENTION

DESCRIPTION OF THE PREFERRED EMBODIMENT

Figure 1:
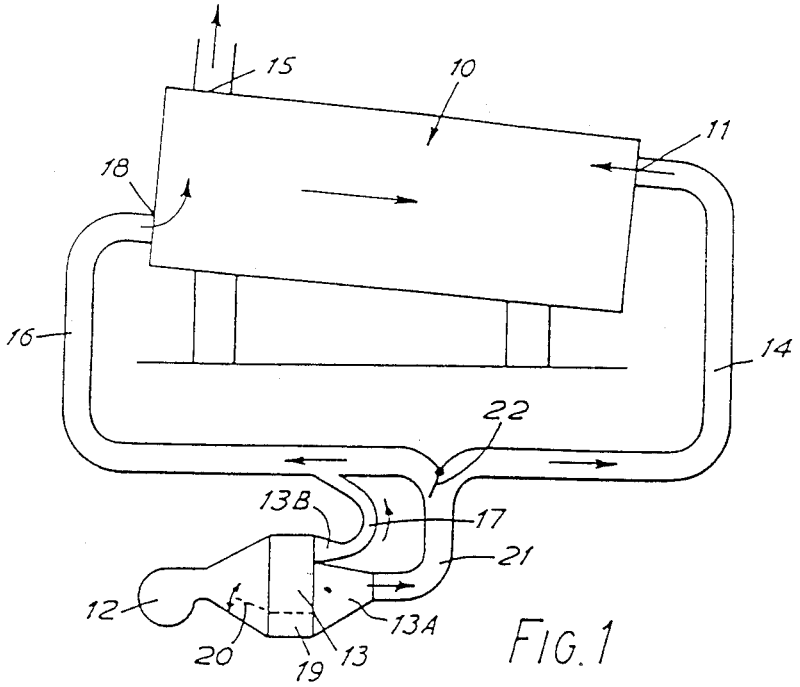
FIG. 1 shows a first embodiment of the invention in schematic outline.

FIG. 1 shows, in schematic outline, a first embodiment of the invention.

The drier shown comprises a rotary drier chamber 10 arranged per se generally as is conventional for such driers with an inclined axis and tobacco moving downwards from left to right through the chamber. The chamber 10 is provided with an air inlet 11 to which air is supplied by means of a blower 12 through a heater 13 and a duct 14. The chamber 10 is also provided with an air outlet 15 through which air is extracted from the chamber by means of an exhaust fan (not shown) to pass to a cyclone duct separator (not shown).

The heater 13 has its outlet divided into two parts 13A and 13B; the first 13A of which is connected to the duct 14, while the second 13B of which is connected to a duct 16, by way of a duct 17, and thence to the outlet end of the chamber by way of a second inlet 18. Thus air from the outlet part 13B of the heater passes more or less straight to the exhaust fan and forms the so called boost air.

The part of the heater 13 which is associated with the outlet part 13A, has an associated bypass 19 flow through which is controlled a movable flap 20 to vary the heating of the air leaving the outlet part 13A in known manner per se.

After a division of the main amount of air in the heater 13 for temperature control the air is passed through a duct 21 and then divided a second time between the ducts 14 and 16, so that a first part passes through the duct 14 to the drier and a second part passes through the duct 16 to the outlet end of the chamber thus to the exhaust 15, where it combines again with the first part and the booster air. In this way the air flow through the drier chamber 10 can be altered without affecting the total air flow or the balance.

The air flow throuh the duct 14 to the drier chamber is adjusted by a pivoted damper flap 22 in the junction between the ducts 14 and 16. This produces a non-linear relationship between air flow and damper angle, large angles of change from fully open on either side producing only small changes of flow until the damper is nearly closed.

Thus the rate of flow through the chamber of the heated drying air from the duct 14 may be controlled by the damper flap 22 in response to the moisture content of the tobacco, entering or leaving the chamber 10, by means of sensors not shown. If less drying is required, the air flow is reduced with the result that the humidity of the air in the chamber 10 is increased and thus the temperature of the tobacco therein is increased with a resultant decrease in the drying effect. In this way a simple system for varing air flow through the drier, without the need for a very sensitive pressure measurement, and without varying the overall air flow through the system from the optimum, may be provided.

A computer (not shown) is used to control the drying process, and from stored data and program can predict the degree of air flow change required to correct the measured error. It is therefore necessary that the air flow can be set predictably. This is best achieved by having a linear relationship between the air flow the and the adjusting means 22.

Figure 2:
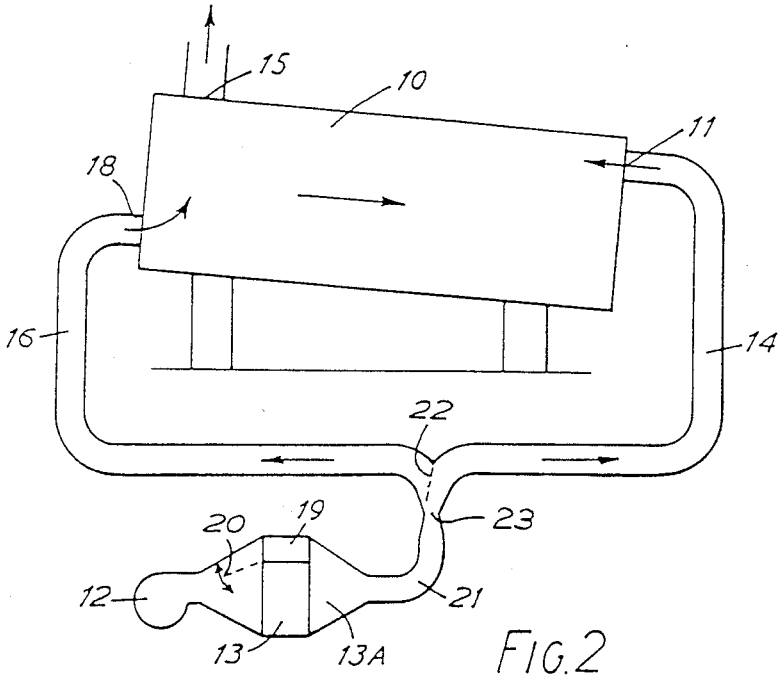
FIG. 2 shows a similar view of a second embodiment of the invention.

In a second embodiment of the invention shown in FIG. 2, a system for varying the air flow through the drier with a linear relationship between movement of the damper flap and air flow rate, is provided. In FIG. 2 the boost air is omitted, but otherwise parts having a similar function to those of FIG. 1 are given the same reference numbers.

To maintain a constant total air flow the total air resistance of the inlet air path must be constant. The path through the chamber 10 is of low air resistance and the path through the duct 16 should be made similarly low by using a large duct. The rest of the inlet system should be of high resistance so that differences in the two paths are not significant. This is best achieved by reducing the cross-section of the duct 21 locally at the divider to give an air velocity of 8,000 fpm or more. This will provide a local high resistance preferably in the form of a square cross-section orifice 23 at the point of division. As the damper flap 22 moves across the orifice 23 it will divide the flow according to the area either side of the flap 22, that is linearly with movement while the total flow will be constant.

For greater accuracy the air flow in the duct 14 to the chamber can be measured by flow transducer (not shown) of the differential pressure or turbine type and the signal used to control the damper flap 22 to give a set flow rate through the duct 14.

A further embodiment of the invention is shown in FIG. 3, and again where parts have a similar function to those of FIG. 1, they are given the same reference numbers.

In the previous embodiments the effect of reducing the air flow is to increase the humidity of the air in the chamber 10 which in turn raises the temperature of the tobacco and reduces the temperature difference for heat transfer.

The same result is achieved in this embodiment by maintaining a constant air flow and altering the humidity by the introduction of steam, or finely dispersed water droplets, into the air duct 14 or direct into the chamber 10, preferably at the delivery end, the air in the duct 14 having been heated to above saturation temperature.

Figure 3:
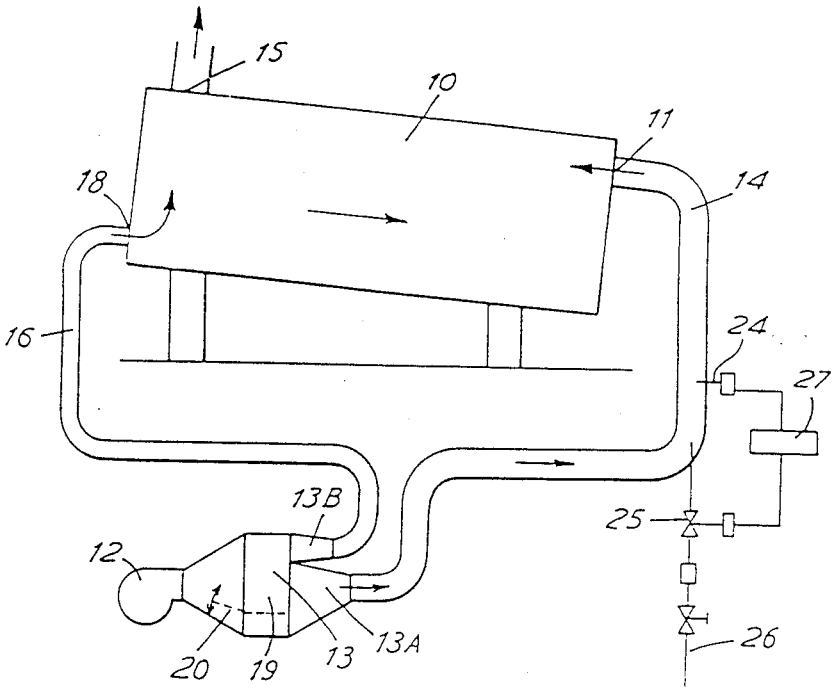
FIG. 3 shows a similar view of a third embodiment of the invention.

This is shown in the embodiment of FIG. 3, where the entire output of the heater outlet part 13A is directed to the duct 15 without division as in the previous embodiments, while only the booster air from the heater outlet 13B is directed to the duct 16.

The amount of steam to be admitted to the duct 14 or the chamber 10 can be controlled by computer 27 or alternatively the humidity can be measured by a transducer 24 and controlled by the computer 27 through a control valve 25 from a supply 26.

While the invention has been described with reference to specific embodiments, modifications and variations of the invention may be made without departing from the scope of the invention which is defined in the following claims.

We claim:

1. A rotary cut tobacco dryer comprising (a) a heated rotary dryer chamber having longitudinal tobacco feed and delivery ends and being arranged to lift and then drop material therein to be dried as the chamber rotates;

(b) an air source;

(c) a heater connected to the air source;

(d) a distributor connected to the heater;

(e) first and second conduit means connected to the heater and connected respectively to the feed and delivery ends of the chamber for supplying heated air from the said heater to both ends of the chamber;

(f) means for extracting the air from the feed end of the chamber, said air source, first and second conduit means and extraction means being of such capacities that there is a substantially constant flow of air through the chamber;

(g) an electronic sensing circuit including a transducing sensor and a computer for sensing moisture content of the tobacco and for producing control signals proportional to the moisture content; and (h) an air humidity control device for receiving said control signals to control the humidity of the air fed to the chamber so that an increase in humidity decreases the rate of drying in the chamber and a decrease in humidity increases the rate of drying in the chamber.

2. A dryer according to claim 1, wherein the control device for controlling the humidity of said air entering the chamber comprises an adjustable flow divider in the distributor for adjustably dividing the flow of air from said heater between said first and second conduits thus to control the rate of flow through the chamber while not altering the total flow of air.

3. A dryer according to claim 2, wherein said control device comprises a pivoted damper flap arranged in the distributor.

4. A dryer according to claim 3, wherein said distributor includes a rectangular cross-section orifice and said damper flap is arranged to pivot across the orifice to divide the flow between the first and second conduits in a substantially linear relationship to movement of the damper flap across the orifice.

5. A dryer according to claim 4, wherein said orifice is formed as a restriction in the flow from the heater to the distributor.

6. A dryer according to claim 1, wherein booster air from said heater is directed directly to said second conduit for flowing to said delivery end of the dryer chamber.

7. A dryer according to claim 1, wherein the humidity of the said air entering or in the dryer chamber is controlled by a steam supplying device for injecting steam into the air which has previously been heated in the heater to above saturation temperature.

* * * * *